US005692549A

United States Patent [19]

Eggers

[11] Patent Number: 5,692,549

[45] Date of Patent: Dec. 2, 1997

[54] FEED ROLLERS FOR CHIPPER

[75] Inventor: Thomas Alan Eggers, Yankton, S. Dak.

[73] Assignee: Vermeer Manufacturing Company, Pella, Iowa

[21] Appl. No.: 648,995

[22] Filed: May 17, 1996

[51] Int. Cl.[6] ..... G27L 11/00; B27C 1/12; B27C 1/00

[52] U.S. Cl. ..... 144/247; 144/246.1; 144/248.5; 144/162.1; 241/281; 241/92

[58] Field of Search ..... 198/780; 241/92, 241/185.5, 186.2, 186.35, 277, 281; 144/162.1, 172, 174, 176, 242.1, 246.1, 247, 248.5

[56] References Cited

U.S. PATENT DOCUMENTS

| | | | |
|---|---|---|---|
| 3,524,485 | 8/1970 | Smith . | |
| 3,661,192 | 5/1972 | Nicholson et al. . | |
| 3,661,333 | 5/1972 | Smith | 144/242.1 |
| 3,861,602 | 1/1975 | Smith . | |
| 3,944,147 | 3/1976 | Pletcher . | |
| 3,989,198 | 11/1976 | Blasko . | |
| 4,057,192 | 11/1977 | Smith . | |
| 4,078,590 | 3/1978 | Smith | 144/247 |
| 4,135,563 | 1/1979 | Maucher . | |
| 4,162,769 | 7/1979 | LaPointe . | |
| 4,260,114 | 4/1981 | Herder . | |
| 5,005,620 | 4/1991 | Morey . | |

*Primary Examiner*—W. Donald Bray
*Attorney, Agent, or Firm*—Merchant, Gould, Smith, Edell, Welter & Schmidt, P.A.

[57] ABSTRACT

A chipper for chipping wood material has first and second feed rollers at an inlet. The first and second feed rollers are secured to a frame of the chipper with the axes of the feed rollers being parallel and spaced apart. The first and second feed rollers are free to move in a direction generally transverse to the axes. The feed rollers are biased toward one another. A motor drives at least one of the feed rollers to rotate the feed roller about its axis of rotation.

7 Claims, 5 Drawing Sheets

FEED ROLLERS FOR CHIPPER

BACKGROUND OF THE INVENTION

1. Field of the Invention

This invention pertains to wood chippers, and more particularly to wood chippers having rollers for feeding wood material to a chipper member.

2. Description of the Prior Art

Wood chippers are well known to reduce trees, limbs, branches, bushes and the like, to wood chips. Chippers come in a wide variety of sizes and power ratings to handle wood material of varying sizes.

In so-called "drum-type" chippers, the chipper includes a cylindrical drum which carries knives or blades on a circumferential wall of the drum. The drum is driven to rotate about a cylindrical axis at high velocities. As wood material is urged toward the cylindrical drum, the knives chip away at the wood material. An example of a drum chipper is shown in U.S. Pat. No. 5,005,620 to Morey, dated Apr. 9, 1991.

An additional type of wood chipper is a so-called "disc-type" chipper where cutting knives are carried radially on the face of a spinning disc. An example of a disc chipper is illustrated in U.S. Pat. No. 3,861,602 to Smith, dated Jan. 21, 1975.

In both drum-type and disc-type chippers, the chipper will include an inlet and an outlet. At the inlet, rollers are commonly provided to feed a log or wood material toward the knives. The outlet typically includes a discharge chute to receive chips and direct the chips in a controlled direction so that the chips may be accumulated for subsequent disposal.

Where a chipper includes an inlet having rollers or the like for advancing wood material towards the chipper, commonly two rollers are used. Each roller is mounted with cylindrical axes of the rollers being parallel. One roller is commonly fixed in location and the other roller may be fixed or may be movable toward the fixed roller. With such designs, it has been found that wood material (such as a log) can be admitted into the inlet of the chipper with the longitudinal axis of the log being out of alignment with a path of travel from the rollers to the chipper member. As a consequence of this misalignment, wood material may not be fed towards the chipper member in the most efficient direction. More seriously, when the misaligned wood material engages the chipper member, the dynamics of the chipper member may cause the misaligned wood member to be moved into a more direct line of travel. This realignment of the wood material can cause a free end of the wood material which is exterior of the inlet to the chipper to be moved to the side. If an operator were to be in the vicinity, the wood material (which may be a log of substantial diameter) may knock into the operator.

It is an object of the present invention to provide a chipper where the feed rollers may float to accommodate possible misalignment of material being fed into the chipper.

SUMMARY OF THE INVENTION

According to a preferred embodiment of the present invention, a chipper for chipping wood material has a frame with a chipping member (such as a drum) carried on the frame. The frame has a material inlet for feeding material to be chipped to the chipping member. The material inlet includes two feed rollers. The feed rollers are secured to the frame with the axes of the feed rollers in generally parallel alignment. Each of the feed rollers is movable toward and away from each other along a path of travel which is generally transverse to the axes. A biasing spring urges the first and second feed rollers to move toward each other along the path of travel. At least one of the rollers is provided with a motor to rotate the roller about its axis of rotation.

A BRIEF DESCRIPTION OF THE DRAWINGS

DESCRIPTION OF THE PREFERRED EMBODIMENT

Referring now to the several drawing figures in which identical elements are numbered identically throughout, a description of the preferred embodiment to the present invention will now be provided.

Figure 1:
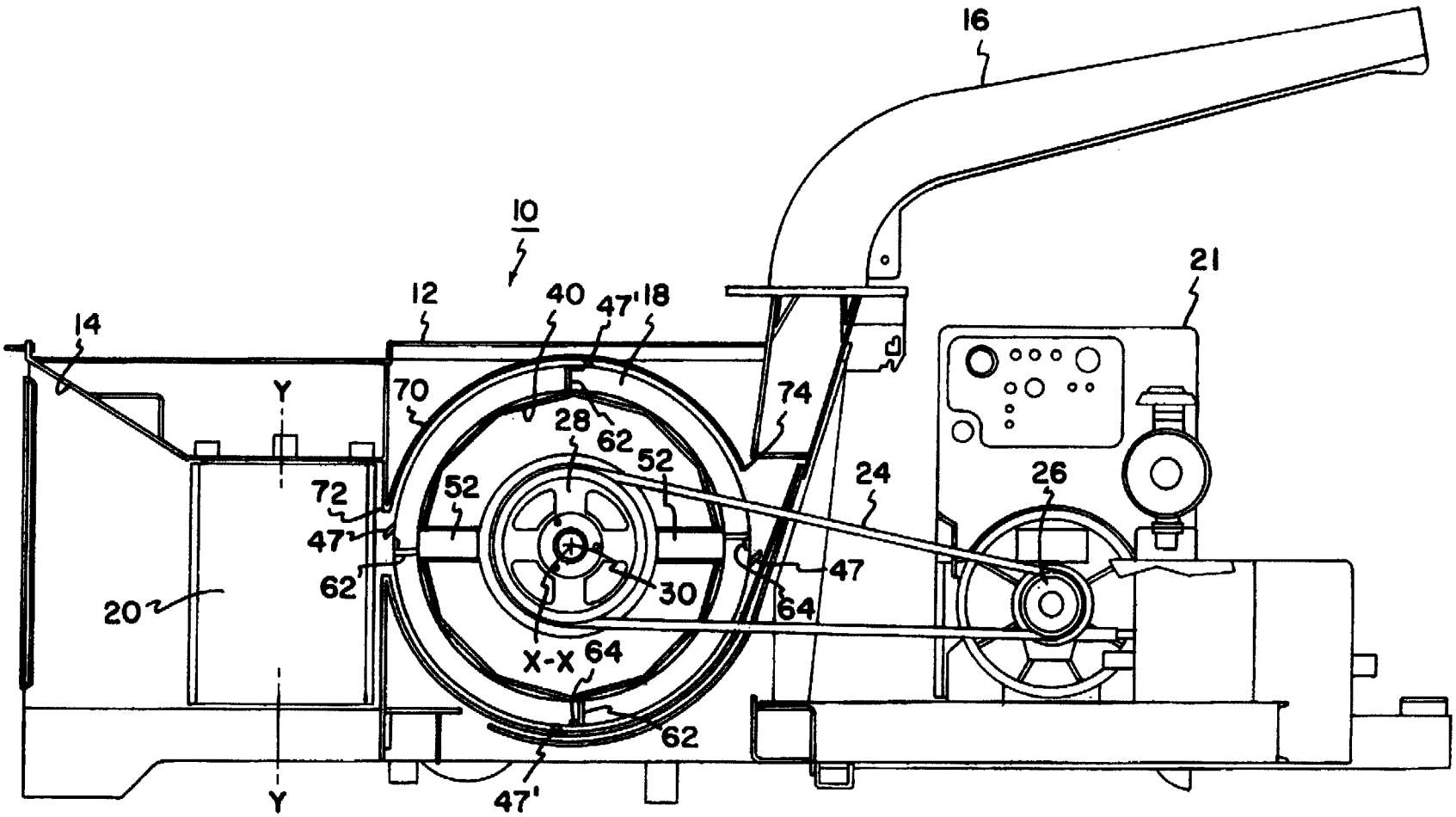
FIG. 1 is a side elevation sectional view showing a chipper incorporating the present invention.

With initial reference to FIG. 1, a chipper 10 is shown including a frame 12 having an inlet end 14 and a discharge chute 16. Positioned between the inlet end 14 and the discharge chute 16 is a rotating drum 18 mounted to rotate about a cylindrical axis X—X. The drum 18 is provided with blades 20 on its circumferential wall.

An engine 21 is mounted on the frame 12 and is coupled to the drum 18 by a belt 22. The engine 21 rotates the drum 18 about its axis X—X.

In a preferred embodiment, the chipper 10 is shown as being a drum-type chipper containing a cylindrical drum 18 with blades 20 on its circumferential wall. This example is given for purposes of illustration. It will be appreciated that the present invention is applicable to other types of chipper members including so-called disc-type chippers.

In operation, wood material is admitted by an operator into the inlet end 14 and fed toward the rotating drum 18. The blades 20 chip away at the wood material with produced chips being discharged through the discharge chute 16 for subsequent disposal.

Figure 2:
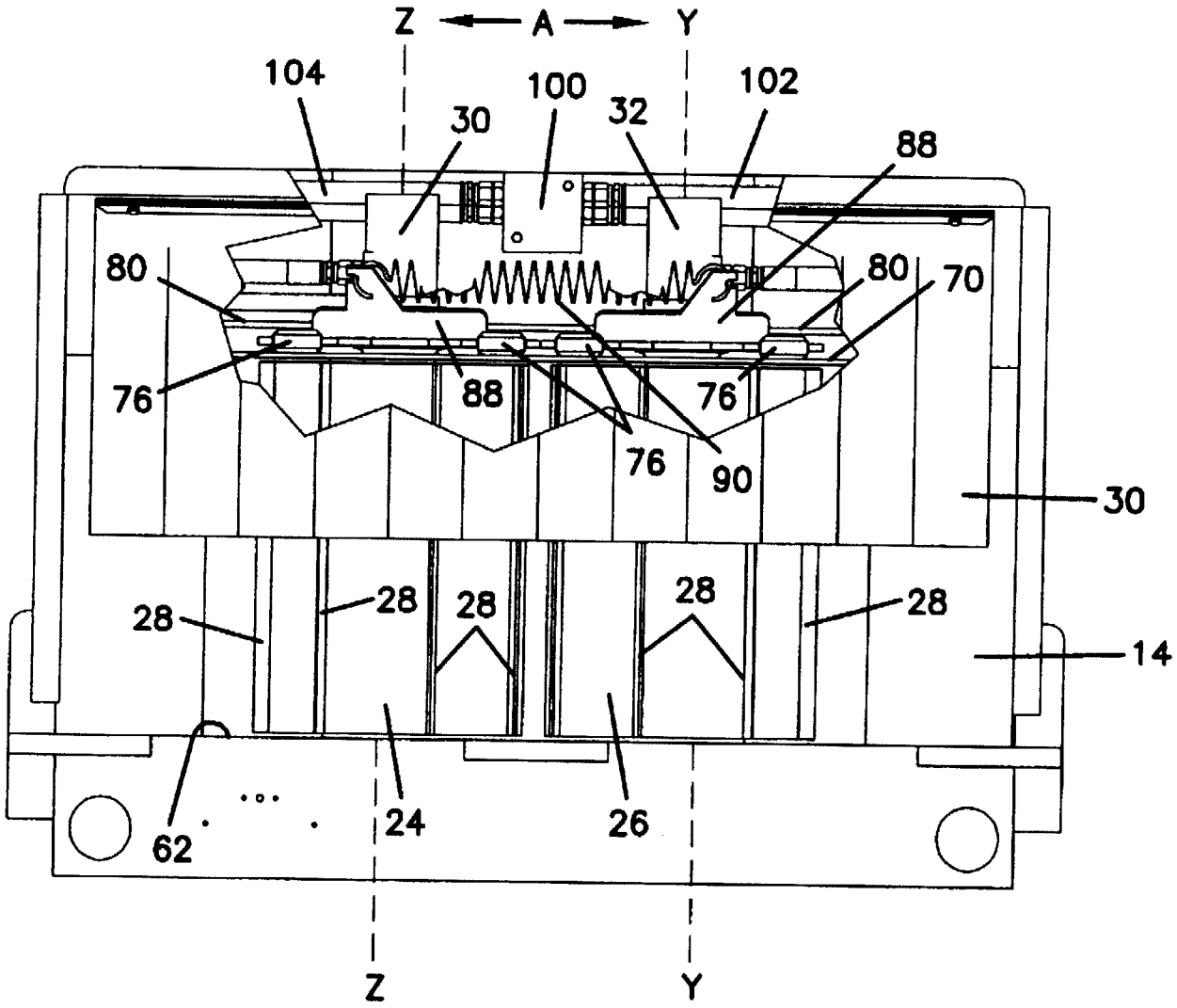
FIG. 2 is a rear elevation view, shown partially in section showing a material inlet to the chipper of FIG. 1.

With reference now to FIG. 2, the inlet end 14 of the chipper 12 is shown and includes two feed rollers 24, 26. Roller 26 is mounted to the frame 12 for the roller 26 to rotate about its cylindrical axis Y—Y. Similarly, roller 24 is mounted to the frame 12 to rotate about its cylindrical axis Z—Z.

Each of the rollers 24, 26 is provided with axially extending ribs 28 on the circumferential face of the rollers 24, 26. The ribs 28 will engage wood material to grip the wood material and advance it toward the drum 18.

The entrance 14 may be provided with a curtain 30 to restrict admission of material towards the rollers 24, 26 when the chipper is not in use and to prevent an operator from inadvertently contacting the rollers 24, 26. The curtain 30 also blocks chips that might be deflected out the rear of the apparatus 10. Each of the rollers 24, 26 is provided with a hydraulic motor 30, 32 for rotating the rollers 24, 26 about their axes.

As will be described, the rollers 24, 26 are free floating in that the rollers 24, 26 can be moved toward and away from each other along a path of travel (A) which is transverse to the axes Y—Y and Z—Z.

Figure 4:
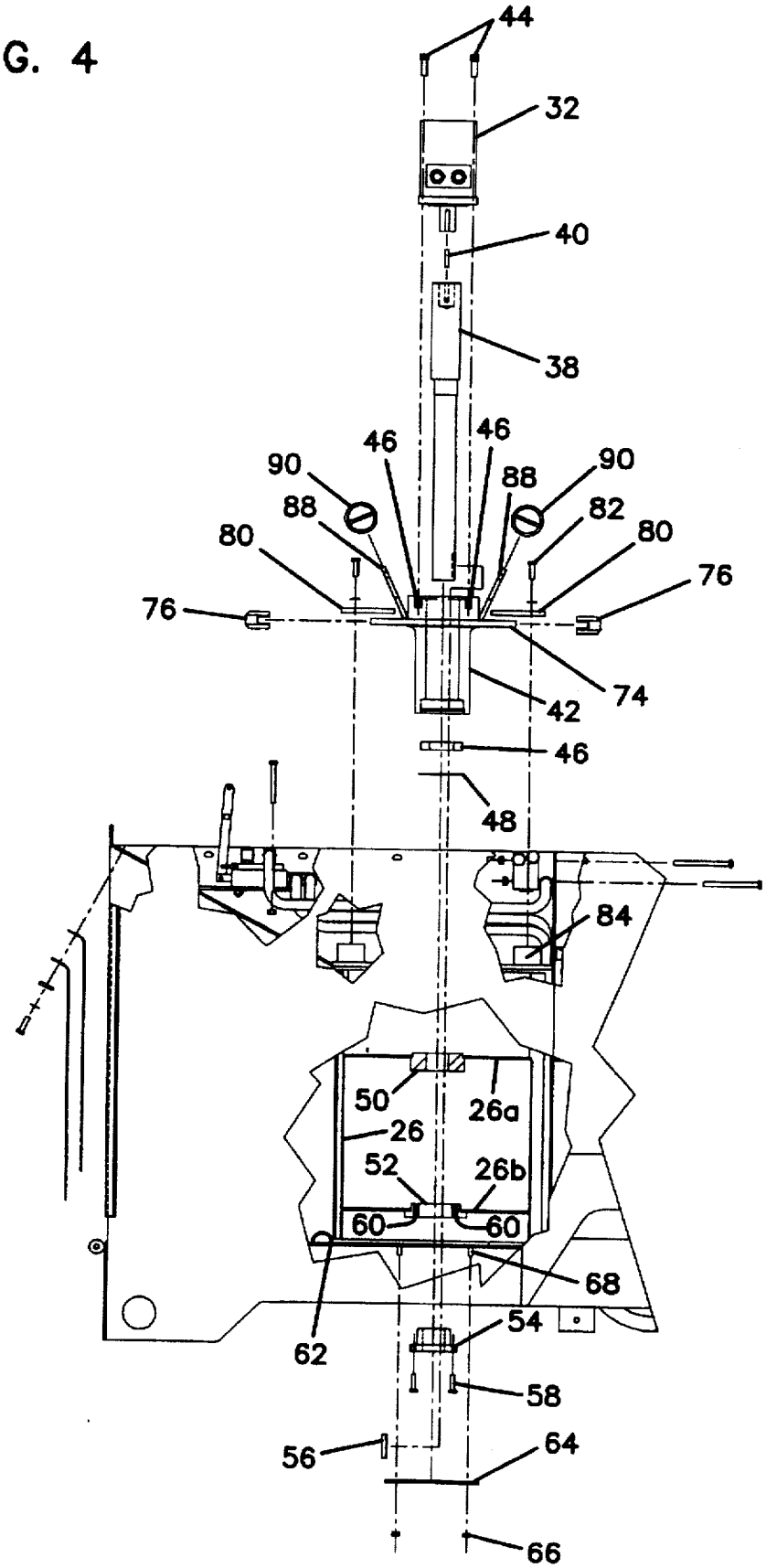
FIG. 4 is a side sectional view shown in exploded format showing a roller assembly for use in the present invention.

With reference to FIG. 4, the assembly of roller 26 is illustrated. It will be appreciated that the assembly of roller 24 is identical.

As illustrated in FIG. 4, motor 32 is connected to a shaft 38 by a key 40. The shaft 38 extends through a sleeve 42 with the motor 32 being secured to the sleeve 42 by means of bolts 44 received in bolt holes 46. The shaft 38 is freely rotating within sleeve 42 and is supported therein by a bearing 46 contained within sleeve 42. The sleeve 42 carries a snap ring 48 to retain bearing 46.

The roller 26 includes a top plate **26*a* and a bottom plate 26*b*. The top plate 26*a* includes an axially centered hub 50 for passing the shaft 38. Further, the bottom 26*b* includes an axially aligned hub 52 which also passes the shaft 38. A tapered hub 54 is provided to be received within hub 52 and to be secured to the shaft 38 for rotation therewith by means of a key 56. The tapered hub 54 is secured to hub 52 by means of bolts 58 received within bolt holes 60. Accordingly, when assembled as described, the drum 26 rotates by means of the motor 32 rotating shaft 38 which, in turn rotates tapered hub 54 which is secured to the roller 26**.

The inlet 14 is provided with a floor 62. The floor 62 may, again a preferred embodiment, have an access opening permitting a mechanic to have access to bolts 58. The access opening may be covered by a plate 64 secured to the floor 62 by means of nuts 66 received on threaded studs 68.

Figure 3:
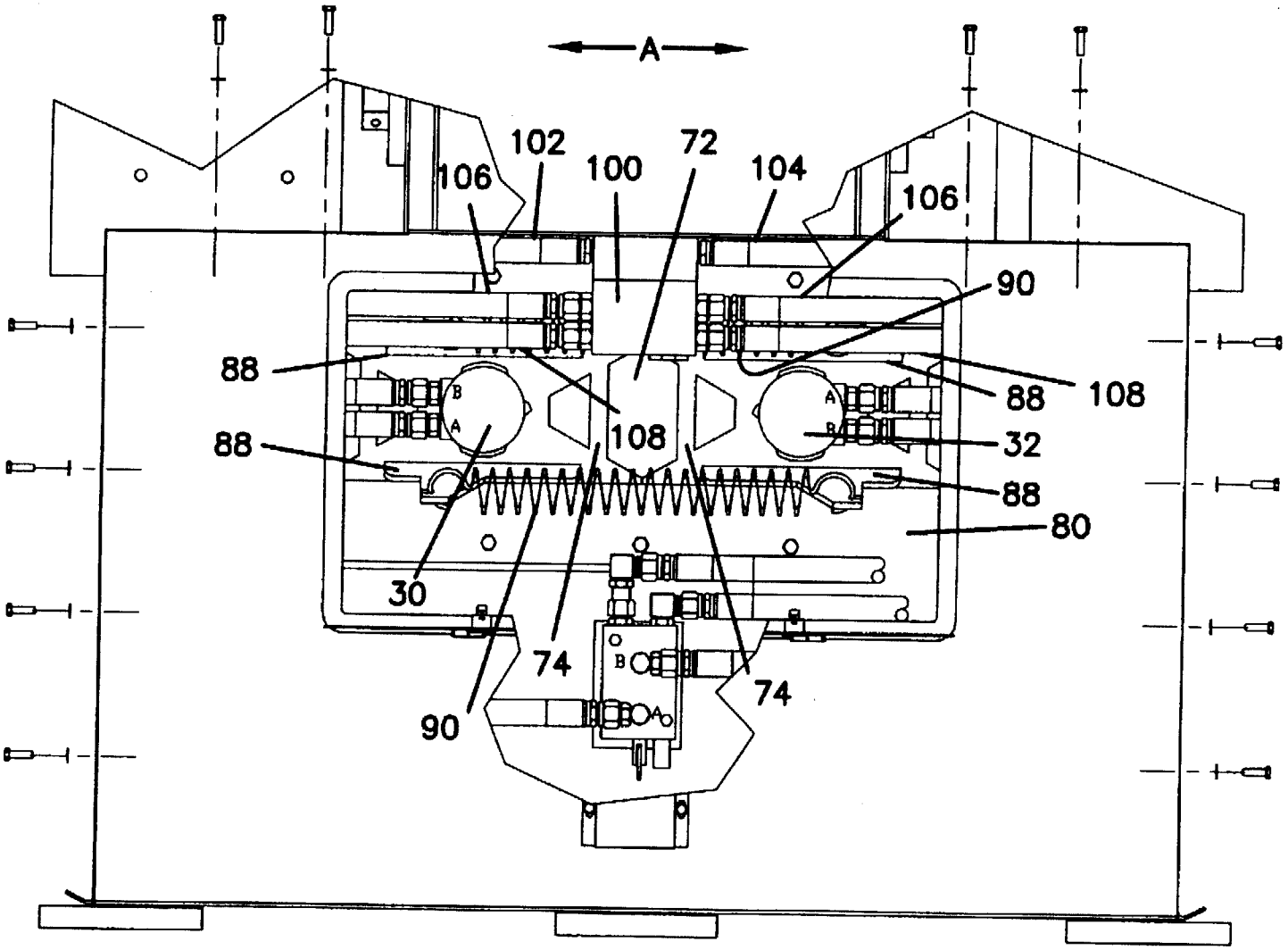
FIG. 3 is a top plan view, shown partially in section, showing an inlet end of the chipper of FIG. 1.

Referring back FIG. 2, the inlet 14 is provided with a top wall 70 which is generally parallel to the bottom wall 62. The top wall 70 is provided with a slot 72 (FIG. 3) extending transversely across the width of the chipper inlet 14.

Shown in FIG. 4, sleeve 42 is provided with a plate 74 wider than slot 72 such that the plate 74 may rest on top wall 70 and not pass through slot 72. Accordingly, the plates 74 support the rollers 26, 24 and keep the rollers from contacting the floor 62 of the inlet.

Side edges of the plate 74 are provided with low friction slide blocks 76, which slide on plate 70 on opposite sides of slot 72. Top plates 80 are secured to the top wall 70 by bolts 82 received within spacer blocks 84. The spacer blocks 84 maintain the top plates 80 in parallel-spaced apart alignment to the top wall 70 and spaced from top wall 70 by a distance slightly greater than the thickness of the slide blocks 76. Accordingly, the slide blocks 76 are captured between the top plates 80 and the top wall 70 with the slide blocks 76 permitting sliding movement of the sleeve 42 in the direction A illustrated in FIGS. 2 and 3.

The sleeves 42 are provided with upwardly extending plates 88. Springs 90 are connected to the plates 88 on opposite sides of the motors 30, 32 with the springs 90, urging the slides 42 toward one another in the direction A.

In a preferred embodiment, the motors 30, 32 are hydraulic motors. Hydraulic fluid is admitted to a manifold 100 (FIG. 3) via inlet and exhaust lines 102, 104. The manifold 100 distributes the hydraulic fluid into secondary inlet and exhaust lines 106, 108 which feed the motors 30, 32.

With the construction thus described, it will be appreciated that the feed rollers 24, 26 are rotated by motors 30, 32 to advance wood material towards the chipper member 18. The rollers 24, 26 may be spread apart to accommodate large or small diameter logs or other volumes of wood material to be chipped. Furthermore, both rollers may float to either the right or the left (in the view of FIG. 2) to accommodate a log or other material to be chipped which is fed out of alignment with the direction of the path to the chipper member. This operation is illustrated in FIGS. 5 through 8.

Figure 5:
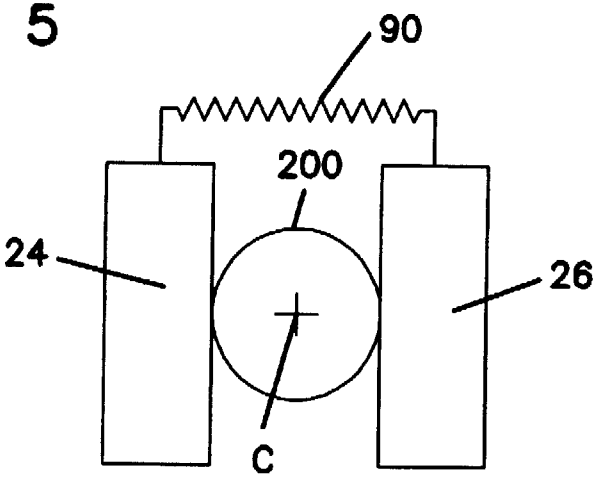
FIG. 5 is a schematic end view of a large diameter log positioned between two rollers according to the present invention where the axis of the log is centered with the center of a chipper member.
Figure 6:
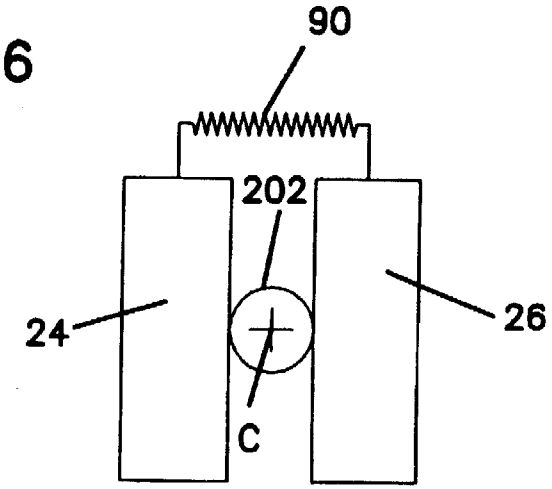
FIG. 6 is the view of FIG. 5 showing a small diameter log.

In FIG. 5, a large diameter log 200 is shown being longitudinally aligned with the center C of the chipper member and with the rollers 24, 26 spread apart to accommodate the size of the large log 200 in equal distance from the center C. The spring 90 urges the rollers 24, 26 against the log 200. In FIG. 6, a smaller diameter log 202 is shown with log 202 also being directly aligned with the center C of the chipper member. The spring 90, maintains the rollers 24, 26 snugly against the log 202.

Figure 7:
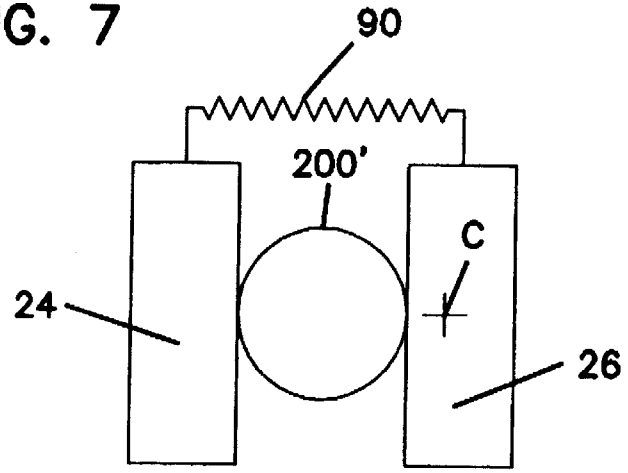
FIG. 7 is the view of FIG. 5 in showing the axis of the large diameter log being offset from the center of the chipper member.
Figure 8:
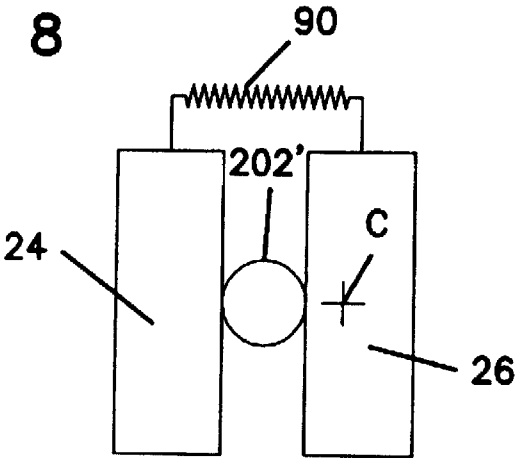
FIG. 8 is the view of FIG. 7 with a small diameter log.

In the event a log is fed into the inlet 14 at an angle such that it is not already properly aligned with the center C of the inlet, instead of forcing the log into alignment, the novel roller system realigns the positioning of the rollers 24, 26. This is shown in FIG. 7 where a large diameter log 200' has been fed such that it is out of alignment with the center C of the inlet. Rather than forcing the log 200' into alignment with this center C, the rollers 24, 26 float to the left (in the view of FIG. 7) and are urged against the log 200' by the spring 90. FIG. 8 shows a similarly misaligned small diameter log 202' with the rollers 24, 26 urged against the log 202' by the spring 90.

From the foregoing detailed description of the preferred embodiment, it has been shown how the present invention has been attained. Modifications and equivalents of the disclosed concepts are intended to be included within the scope of the claims which are impended hereto.

I claim:

1. A chipper for chipping wood material with said chipper having a frame with a chipping member carried on said frame and a material inlet end for feeding material to be chipped to said chipping member, said material inlet end comprising:

a first feed roller and a second feed roller;

each of said first and second feed rollers secured to said frame at said inlet end with a space between said first and second feed rollers defining a material feed path leading from said inlet end to said chipping member;

said first and second feed rollers having first and second axes of rotation, respectively;

said first and second feed rollers each secured to said frame with said axes in generally parallel alignment and with said feed rollers movable toward and away from each other along a path of travel generally transverse to said axes to define a separation gap between said first and second rollers of variable length;

said first and second feed rollers resiliently biased to move toward each other along said path of travel and with said first and second rollers free floating with respect to said frame for a center point of said separation gap to freely move in response to positioning of a wood material being fed along said feed path; and at least a first motor for driving at least one of said first and second rollers to rotate said at least one about its respective axis of rotation.

2. A chipper according to claim 1 wherein said first and second feed rollers are secured to first and second support platforms, respectively, and said support platforms are mounted on said frame for each of said support platforms to be movable toward and away from each other along said path of travel;

a spring connecting said first and second support platforms.

3. A chipper according to claim 1 wherein said first motor is connected to said first roller for rotating said first roller about said first axis of rotation; and a second motor connected to said second roller for rotating said second roller about said second axis of rotation.

4. A chipper according to claim 1 wherein said frame at said inlet includes a top wall having a slot formed therein an extending transverse to said path of travel;

said feed rollers each including a feed roller assembly including said rollers and support members;

said rollers positioned within said inlet beneath said top wall and said support members positioned above said top wall and out of said inlet.

5. A chipper according to claim 4 wherein said support members include a plate for each of said rollers with said plate positioned above said top wall and slidably engaging said top wall for said plates to slide along a direction of said slot and with said rollers including support shafts rotatably mounted on said plates.

6. A chipper according to claim 5 wherein said biasing means includes springs connecting said plates and urging said plates toward each other.

7. A chipper according to claim 6 comprising a motor on each of said plates and coupled to said plate for movement therewith and coupled to said shafts for rotating said shafts.

* * * * *